US009482089B2

(12) United States Patent
Delmar et al.

(10) Patent No.: US 9,482,089 B2
(45) Date of Patent: Nov. 1, 2016

(54) RECEIVING AND MEASURING EXPELLED GAS FROM A CORE SAMPLE

(71) Applicant: Halliburton Energy Services, Inc., Houston, TX (US)

(72) Inventors: Ludovic Delmar, Prefailles (FR); Benjamin Llywelyn Evans, Uccle (BE); Adrien P. C. Henry, Gesves (BE); Svein Ravndal, Figgjo (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/902,822

(22) PCT Filed: Aug. 1, 2013

(86) PCT No.: PCT/US2013/053159

§ 371 (c)(1),
(2) Date: Jan. 4, 2016

(87) PCT Pub. No.: WO2015/016928

PCT Pub. Date: Feb. 5, 2015

(65) Prior Publication Data

US 2016/0194955 A1 Jul. 7, 2016

(51) Int. Cl.

| | |
|---|---|
| ***E21B 49/06*** | (2006.01) |
| ***E21B 49/08*** | (2006.01) |
| ***E21B 43/38*** | (2006.01) |

(52) U.S. Cl.
CPC ..... *E21B 49/081* (2013.01); *E21B 43/38* (2013.01); *E21B 49/084* (2013.01)

(58) Field of Classification Search
CPC ..... E21B 43/38; E21B 49/081; E21B 49/084
USPC ..... 73/152.09, 152.11, 152.23, 19.01, 73/19.12, 19.09, 863.21, 864.34, 864.44
See application file for complete search history.

(56) References Cited

U.S. PATENT DOCUMENTS

| | | |
|---|---|---|
| 2,341,169 A | 2/1944 | Long, Jr. et al. |
| 2,347,726 A | 5/1944 | Auld et al. |

(Continued)

FOREIGN PATENT DOCUMENTS

| | | | |
|---|---|---|---|
| WO | 2010/111726 | 10/2010 | E21B 49/02 |
| WO | 2011/085444 | 7/2011 | E21B 49/02 |
| WO | 2012/112154 | 8/2012 | E21B 21/06 |

OTHER PUBLICATIONS

International Search Report and Written Opinion, Application No. PCT/US2013/053159, 16 pages, Apr. 28, 2014.

(Continued)

*Primary Examiner* — Robert Huber
*Assistant Examiner* — Anthony W Megna Fuentes
(74) *Attorney, Agent, or Firm* — Baker Botts L.L.P.

(57) ABSTRACT

An example system for receiving gas expelled from a core sample of a formation may include a tubular element. A core chamber may be disposed within the first tubular element. A gas and drilling fluid separator may be in fluid communication with the core chamber. The tubular element may be an inner barrel assembly of a core sample assembly that is disposed within a borehole. A core sample may be contained within the inner barrel assembly and may be retrieved at the surface. Gas may be expelled from the core sample as it is retrieved, and the gas and drilling fluid separator may separate the expelled gas from suspension with a drilling fluid for analysis.

15 Claims, 3 Drawing Sheets

(56) References Cited

U.S. PATENT DOCUMENTS

| | | | | |
|---|---|---|---|---|
| 2,445,494 | A | 7/1948 | Redmond | |
| 4,230,192 | A | 10/1980 | Pfannkuche | |
| 4,492,275 | A | 1/1985 | Campbell et al. | |
| 4,955,438 | A | 9/1990 | Juergens et al. | |
| 5,447,052 | A * | 9/1995 | Delaune | G01N 30/06 422/78 |
| 5,482,123 | A | 1/1996 | Collee | |
| 5,859,430 | A | 1/1999 | Mullins et al. | |
| 6,719,070 | B1 | 4/2004 | Puymbroeck et al. | |
| 7,379,819 | B2 | 5/2008 | Betancourt et al. | |
| 7,779,667 | B2 * | 8/2010 | Evrard | B01D 19/0063 73/19.01 |
| 8,307,704 | B2 | 11/2012 | Georgi et al. | |
| 8,342,004 | B2 | 1/2013 | Richards | |
| 8,430,186 | B2 | 4/2013 | Reid et al. | |
| 8,898,018 | B2 | 11/2014 | Pariag et al. | |
| 8,985,218 | B2 | 3/2015 | Bedouet et al. | |
| 9,127,546 | B2 | 9/2015 | Quigley et al. | |
| 2006/0254421 | A1 * | 11/2006 | Boone | E21B 21/067 95/260 |
| 2010/0200242 | A1 * | 8/2010 | Rodger | E21B 43/34 166/369 |
| 2010/0258306 | A1 * | 10/2010 | Camilleri | E21B 43/128 166/265 |
| 2011/0247879 | A1 * | 10/2011 | Johnston | E21B 25/00 175/58 |
| 2012/0217065 | A1 | 8/2012 | Gray | |
| 2012/0261191 | A1 | 10/2012 | Klomp et al. | |
| 2012/0305315 | A1 | 12/2012 | Bedouet | |

OTHER PUBLICATIONS http://www.upstreampumping.com/article/production/downhole-gas-separators; 6 pages.

* cited by examiner

RECEIVING AND MEASURING EXPELLED GAS FROM A CORE SAMPLE

CROSS-REFERENCE TO RELATED APPLICATION

This application is a U.S. National Stage Application of International Application No. PCT/US2013/053159 filed Aug. 1, 2013, which is incorporated herein by reference in its entirety.

BACKGROUND

The present disclosure relates generally to well drilling operations and, more particularly, to receiving and measuring expelled gas from a core sample.

Hydrocarbons, such as oil and gas, often reside in various forms within subterranean geologic formations. Often, a coring tool is used to obtain representative samples of rock taken from a formation of interest. Such rock samples obtained are generally referred to as "core samples." Analysis and study of core samples enable engineers and geologists to assess important formation parameters such as the reservoir storage capacity, the flow potential of the rock that makes up the formation, the composition of the recoverable hydrocarbons or minerals that reside in the formation, and the irreducible water saturation level of the rock. For instance, information about the amount of fluid may be useful in the subsequent design and implementation of a well completion program that enables production of selected formations and zones that are determined to be economically attractive based on the data obtained from the core sample.

FIGURES

Some specific exemplary embodiments of the disclosure may be understood by referring, in part, to the following description and the accompanying drawings.

Figure 1A:
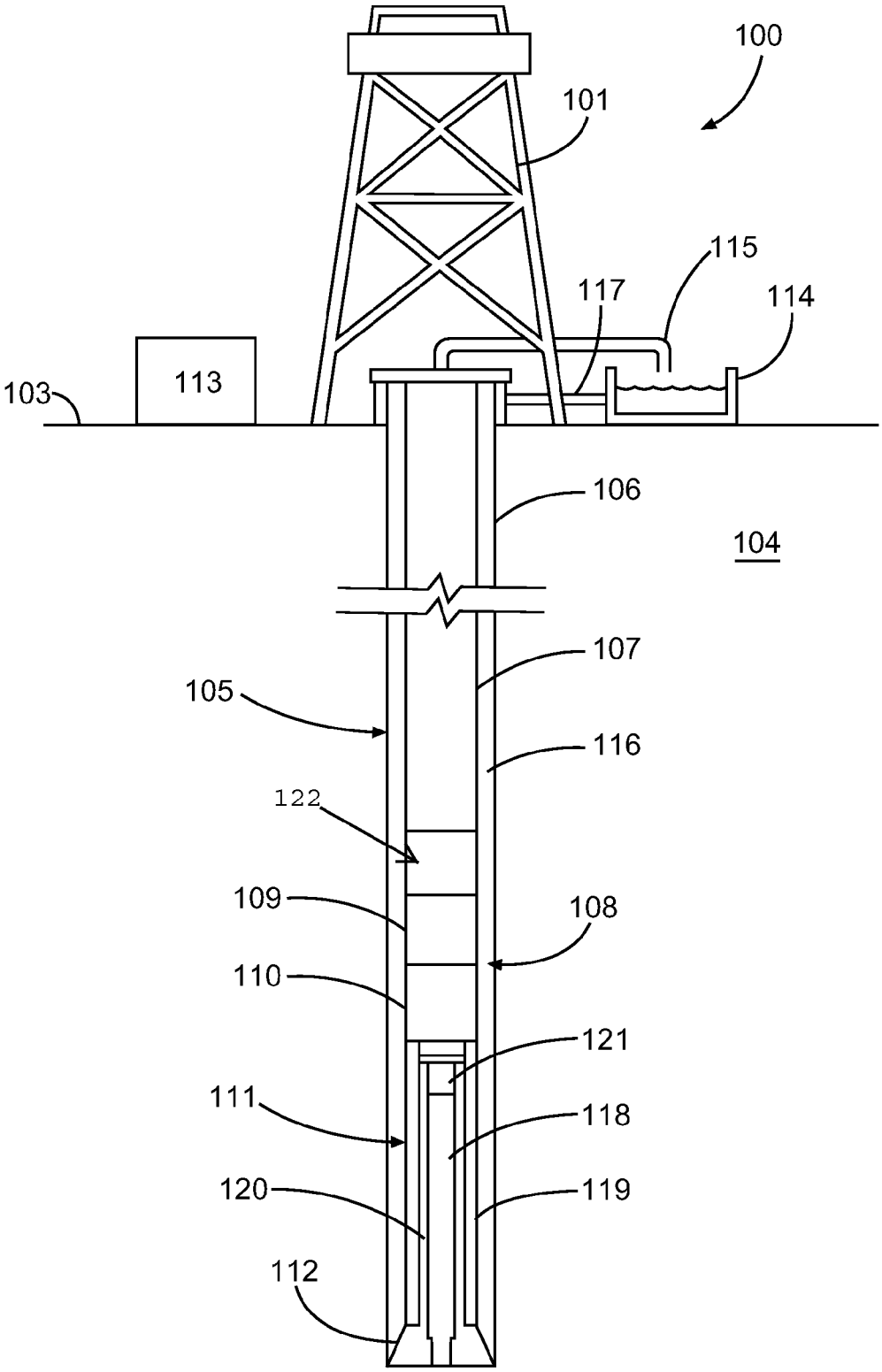
FIGS. 1A and 1B are diagrams illustrating an example drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to well drilling operations and, more particularly, to receiving and measuring expelled gas from a core sample.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to drilling operations that include but are not limited to target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Modern petroleum drilling and production operations demand information relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections. The indefinite articles "a" or "an," as used herein, are defined to mean one or more than one of the elements that it introduces. The terms "gas" or "fluid", as used in the claims and this disclosure, are not limiting and are used interchangeably to describe a gas, a liquid or any other type of fluid.

Figure 1B:
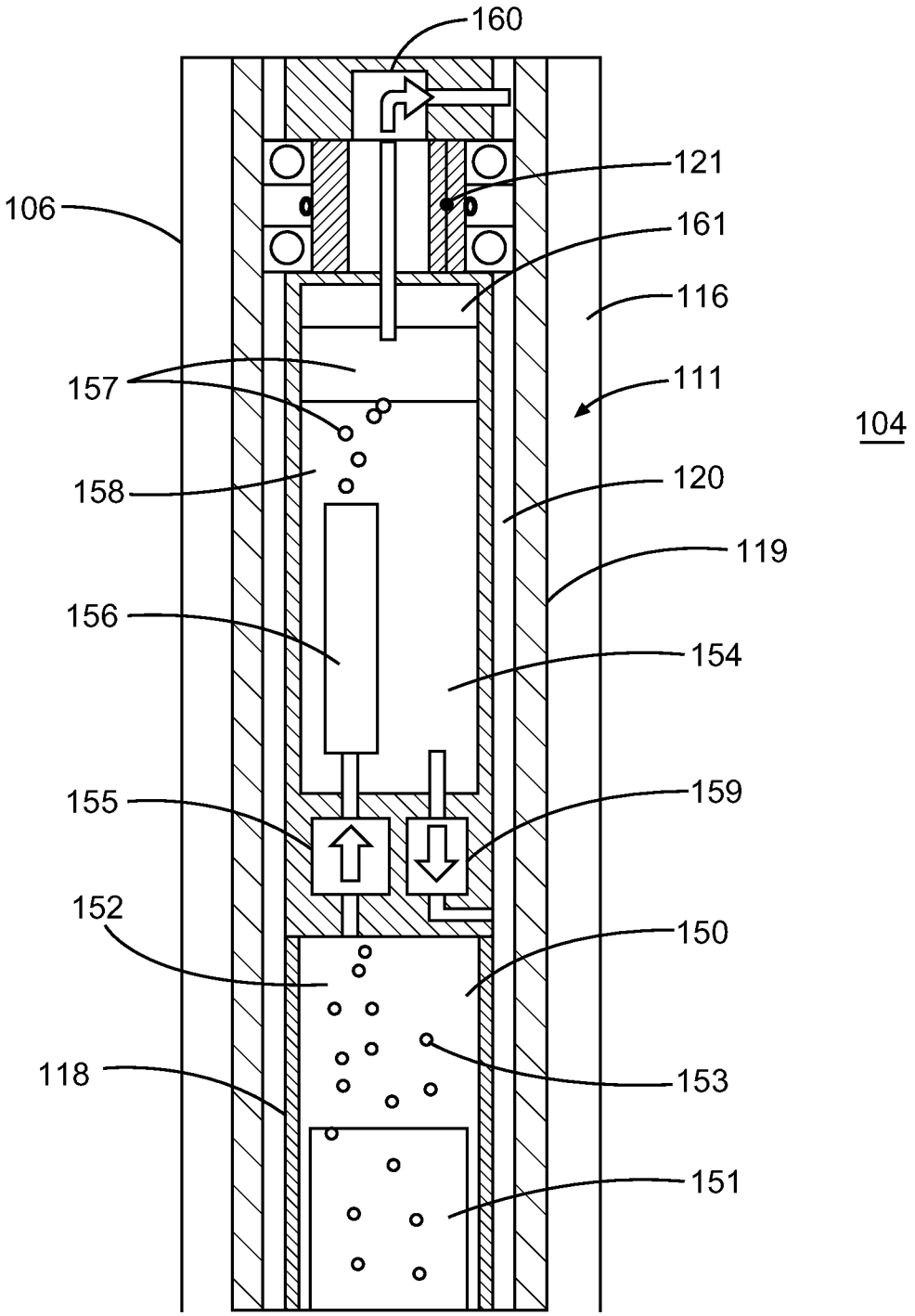

FIGS. 1A and 1B are diagram illustrating an example drilling system 100, according to aspects of the present disclosure. The drilling system 100 comprises a rig 101 positioned at the surface 103, above a formation 104. Although the rig 101 is shown on land in FIG. 1, the rig 101 may be used at sea, with the surface 103 comprising a drilling platform. The rig 101 may be coupled to a drilling assembly 105 within a borehole 106 in the formation 104. The drilling assembly 105 may comprise a drill string 107 and a bottom hole assembly (BHA) 108. The drill string 107 may be comprised of a plurality of tubular segments that are coupled in series to define an inner bore through which drilling fluid may be pumped, as will be described below. The BHA 108 may comprise a telemetry system 109, a recording module 122, a downhole controller 110, a core sample assembly 111, and a drill bit 112.

The telemetry system 109 may communicate via mud pulses, wired communications, or wireless communications with a surface control unit 113. The surface control unit 113 may comprise, for example, a microprocessor or controller coupled to a memory device that contains a set of instructions. The set of instructions, when executed by the processor, may cause the processor to perform certain actions. The surface control unit 113 may transmit commands to elements of the BHA 108 using mud pulses or other communication media that are received at the telemetry system 109. Likewise, the telemetry system 109 may transmit information to the surface control unit 113 from elements in the BHA 108. For example, downhole measurements of formation 104 and borehole 106 taken within the BHA 108 may be transmitted to the surface control unit 113 through the telemetry system 109.

Like the surface control unit 113, the downhole controller 110 may comprise a microprocessor or a controller coupled to a memory device. The downhole controller 108 may issue commands to elements within the BHA 108. The commands may be issued in response to a separate command from the surface control unit 113, or the downhole controller 110 may issue the command without being prompted by the surface control unit 113. In certain embodiments, as will be described below, elements of the BHA 108 may comprise electric pumps and actuatable valves that may response to commands issued by the downhole controller 110 or surface control unit 113.

During drilling operations, drilling fluid may be pumped into the drill string 107 from a surface reservoir 114 through a pipe 115. The drilling fluid may flow through the drill string 107 and exit from the drill bit 112, lubricating and cooling the cutting face of the drill bit 112 and carrying cuttings from the drill bit 112 to the surface 103. The drilling fluid may return to the surface 103 through an annulus 116 between the drilling assembly 105 and the wall of the borehole 106. The drilling fluid may return to the surface reservoir 114 through a flow pipe 117 in fluid communication within the annulus 116.

The drilling operation may result in a cylindrical core sample 151 being taken from the formation 104. The drill bit 112 may comprise a coring drill bit that has a central opening. The drill bit 112 may have cutting elements that surround the central opening. As the drill bit 112 rotates and cuts into the formation 104, it may form cylindrical core sample 151 by cutting the formation 104 around the core sample 151, but not the portion of the formation 104 from which the core sample 151 is formed. In certain embodiments, the core sample 151 may be retrieved at the surface 103 to perform tests that cannot be performed downhole. In the process of going back to surface 103, the core sample may be subject to variations in its original conditions of pressure, temperature or geometry that may allow fluid and/or gas to be expelled from core sample 151 into drilling fluid within the drilling assembly 105 and borehole 106.

According to aspects of the present disclosure, the core sample 151 may be captured in a tubular element 118, and specifically within a core chamber 150. The core chamber 150 may comprise a chamber within the tubular element 118 that is open to the borehole 106 and substantially aligned with the central opening in the drill bit 112. Once the core sample 151 is formed, it may be captured within the core chamber 150 along with drilling fluid 152 from the drilling operation. The drilling fluid 152 may at least partially fill the core chamber 150. The core sample 151 may remain within the core chamber 150 as it is moved to the surface. In the drilling system 100, the core sample 151 may be moved to the surface and retrieved by "tripping" or removing the drilling assembly 105 from the borehole 106. Gas that is expelled from the core sample 150 may become suspended within the drilling fluid 152, as is indicated by gas bubbles 153 in core chamber 150. A gas and drilling fluid separator 156 may be in fluid communication with the core chamber 150, may receive the expelled gas 153 in suspension with the drilling fluid 152, and may separate the expelled gas 153 from the drilling fluid for storage and testing.

In the embodiment shown, the tubular element 118 comprises an inner barrel assembly of core sample assembly 111. The core sample assembly 111 may further comprise an outer barrel 119 in which the inner barrel assembly 118 is at least partially disposed, forming an annulus 120. The inner barrel assembly 118 may be rotationally coupled to the outer barrel 119 through a swivel assembly 121 that prevents or substantially reduces a rotation of the outer barrel 119 from being imparted to the inner barrel assembly 118. The swivel assembly 121 also may include flow ports (not shown) that allow drilling fluid to flow past the inner barrel assembly 118 and out of the drill bit 112. The outer barrel 119 may be coupled to other elements within the BHA 108, such as the telemetry system 109 or the downhole controller 110. In other embodiments, the outer barrel 119 may be coupled to the drill string 107.

In certain embodiments, the inner barrel assembly 118 may further comprise a gas storage chamber 154 disposed therein. The gas storage chamber 154 may comprise a chamber within the inner barrel assembly 118 that is used for storing gas expelled from the core sample 151 and separated from suspension by the gas and drilling fluid separator 156. The gas and drilling fluid separator 156 may be at least partially disposed within the gas storage chamber 154. The gas storage chamber 154 may be sealed to prevent the unwanted escape of expelled gas.

A pump 155 may be coupled to the gas and drilling fluid separator 156 and provide fluid communication between the core chamber 150 and the gas and drilling fluid separator 156. The pump 155 may comprise, for example, an electric pump that is activated by the downhole controller 110 or the surface control unit 113. In certain embodiments, the pump 155 may be activated by a ball-drop mechanism or another mechanism that would be appreciated by on of ordinary skill in the art in view of this disclosure. When activated, the pump 155 may draw the suspension of expelled gas 153 and drilling fluid 152 from the core chamber 150 into the gas and drilling fluid separator 156. The gas and drilling fluid separator 156 may remove expelled gas 153 from suspension with the drilling fluid 152. The drilling fluid/gas suspension may be separated into a gas volume 157 and a drilling fluid volume 158.

In certain embodiments, the pump 155 may be activated based, at least in part, on a position of the inner barrel assembly 118 or the condition of the core sample 151. For example, the pump 155 may be activated when the inner barrel assembly 118 reaches a vertical portion of the borehole 104 or at the bottom of the borehole 104 when the core sample 151 is taken. In certain embodiments, the pump 155 may be activated when the core sample 151 reaches it bubble point, i.e., the pressure at which gas within the core sample 151 is released.

In certain embodiments, a valve 159 may be in fluid communication with the gas storage chamber 154. The valve 159 may comprise a pressure release check valve that opens to release pressure within the gas storage chamber 154 when the pressure passes a certain threshold. In certain embodiments, the valve 159 may provide selective fluid communication between the gas storage chamber 154 and the annulus 120 between the inner barrel assembly 118 and the outer barrel 119. In certain embodiments, the valve 159 may provide selective fluid communication between the gas storage chamber 154 and the core chamber 150.

In certain embodiments, the gas volume 157 may be pumped and measured by gas measurement and testing elements 161 and discarded through a pump 160 continuously as the core sample 151 moves toward the surface 103. For example, the gas volume 157 may be measured by gas measurement and testing elements 161 to determine properties such as but not limited to chemical composition, volume, pressure, temperature, etc. Gas measurement and testing elements 161 may be incorporated, for example, into the inner barrel assembly 118, between the swivel assembly 121 and the gas storage chamber 154. The gas volume 157 may be discarded in the internal bore of the drill string 107 to avoid recirculation of discarded fluids.

The valve 159 may be located at the bottom of the gas storage chamber 154 so that when it opens, a portion of the mud volume 158 is released rather than a portion of the gas volume 157. The mud volume 158 may be released at the bottom of the tubular element 118 and may create a circulation in the drilling fluid 152 that may displace the drilling fluid 152 around the core sample 151. Such circulation may help gather all gas 153 in a draw zone of the gas storage chamber 154. If the core sample assembly 111 is tilted, the mud volume 158 may not settle next to the valve 159 within the gas storage chamber 154. Accordingly, in certain embodiments, one or more valves may be located at other locations within the gas storage chamber 154, to relieve pressure by evacuating mud volume 158 when the gas storage chamber 154 is in a non-vertical orientation. The valve 159 should be positioned within the mud volume 158 so that it evacuates mud volume 158 rather than gas volume 157.

When the core sample assembly 111 is retrieved at the surface, both the core sample 151 and the gas volume 157 may be tested. For example, the gas volume 157 may be tested to determine its composition, the amount of gas, etc. The core sample 151 may be tested to determine properties such as but not limited to rock composition, rock porosity, gas content, etc. The core sample assembly 111 may advantageously capture all or close to all of the gas and mineral composition of the core sample 151. By enclosing the core sample 151 within the core chamber 150, and capturing all of the gas released from the core sample 151 within the gas storage chamber 154, the surface tests may more accurately reflect to the composition of the formation 104 and the conditions within the borehole 106.

Figure 2:
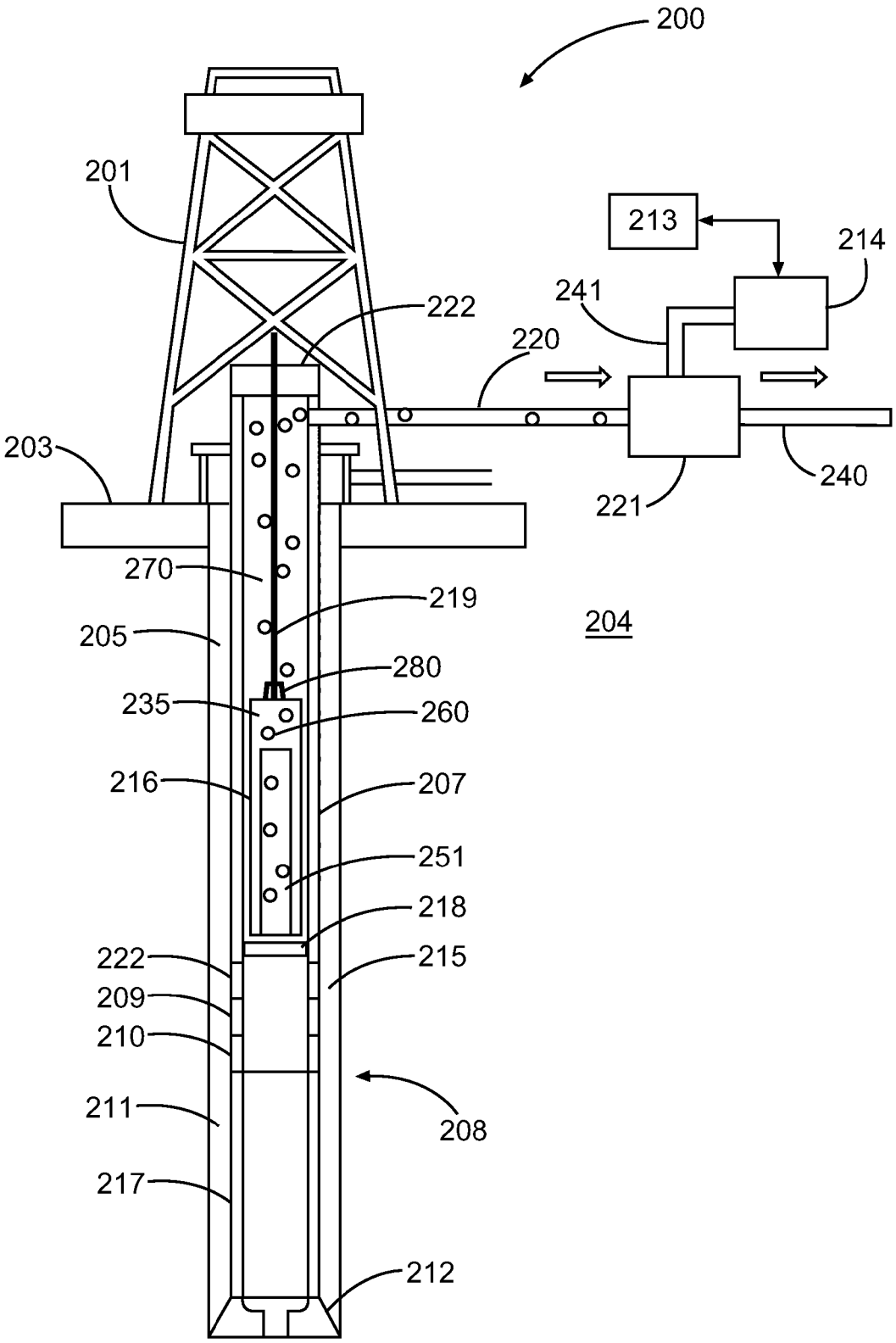
FIG. 2 is a diagram illustrating another example drilling system, according to aspects of the present disclosure.

FIG. 2 is a diagram illustrating another example drilling system 200, according to aspects of the present disclosure. Like drilling system 100, the drilling system 200 may comprises a rig 201 positioned at the surface 203, above a formation 204. The rig 201 may be coupled to a drilling assembly 205 within a borehole 206 in the formation 204. The drilling assembly 205 may comprise a drill string 207 and a bottom hole assembly (BHA) 208. The BHA 208 may comprise a telemetry system 209, a recording module 222, a downhole controller 210, a core sample assembly 211, and a drill bit 212.

In the embodiment shown, a core sample 251 may be captured in a tubular element 216, specifically within a core chamber 235 at least partially disposed therein. The core chamber 235 may be in fluid communication with a gas and drilling fluid separator 221, as will be described below. Like drilling system 100, a tubular element 216 may comprise an inner barrel assembly of a core sample assembly 211. The inner barrel assembly 216 may be at least partially disposed within and an outer barrel 217 of the core sample assembly 211. Unlike inner barrel assembly 118 of core sample assembly 111, however, inner barrel assembly 216 of core sample assembly 211 may be detachably coupled to the outer barrel 217 and independently retrievable at the surface via a wireline assembly 219. The wireline assembly 219 may include a latching assembly 280 on its distal end that is configured to latch onto an attachment element on the inner barrel assembly 216. The latching assembly may take a variety of configurations that would be appreciated by one of ordinary skill in the art in view of this disclosure.

In certain embodiments, the inner barrel assembly 216 may be retrieved to the surface either independently via a wireline assembly 219 or by removing the entire drilling assembly 205. In certain other embodiments, the inner barrel assembly 216 may comprise at least one tubular element that is lowered and removed from a borehole via a wireline, slickline, or other similar element. For example, a wireline sampling tool may comprise a tubular element that is coupled to a downhole motor and a coring drill bit. The wireline sampling tool may capture a core sample and be retrieved to the surface without requiring the use of a drill string.

During drilling operations, drilling system 200 may operate similarly to drilling system 100. In particular, drilling fluid may be pumped into the drill string 207 from a surface reservoir (not shown), and the drilling fluid may flow through the drill string 207 and exit from the drill bit 212. The drilling fluid may return to the surface 203 through an annulus 215 between the drilling assembly 205 and the wall of the borehole 206. Unlike drilling system 100, however, when the core sample 251 has been taken and is located within the inner barrel assembly 216, the core sample 251 can be retrieved with wireline assembly 219 without removing the entire drilling assembly 205. In certain embodiments, the wireline 219 may be introduced through a surface blow-out preventer (BOP) 222 installed onto the drill pipe 207. The BOP 220 may prevent pressure trapped within the drill pipe 207 from being released. Once the wireline 219 is coupled to the inner barrel assembly 216, the inner barrel assembly 216 may be released from the outer barrel 217, allowing the inner barrel assembly 216 and the core sample 251 to be retrieved at the surface 203.

In the embodiment shown, the gas and drilling fluid separator 221 is in fluid communication with the core chamber 235 through a flow line 220 that is open to the bore of the drill string 207. Specifically, the core chamber 235 may be in fluid communication with the internal bore of the drill string 107, and the gas and drilling fluid separator 221 is in turn in fluid communication with the internal bore of the drill sting 107. The gas and drilling fluid separator 221 may be positioned at the surface 203. As the inner barrel assembly 216 is retrieved to the surface, gas 260 trapped within the core sample 216 may be expelled into drilling fluid 270 within the drill string 207. The expelled gas 260 may be held in suspension within the drilling fluid 270. The gas and drilling fluid separator 221 may separate the expelled gas 260 from suspension with the drilling fluid 270. In certain embodiments, the drilling fluid 270 separated by the gas and drilling fluid separator 221 may be sent to the surface reservoir though a pipe 240.

The gas and drilling fluid separator 221 may be in fluid communication with a gas analyzer 214. In the embodiment shown, the gas and drilling fluid separator 221 is in fluid communication with a gas analyzer 214 through a pipe 241. The gas analyzer 214 may include, for example, a gas storage tank, where the expelled gas 260 may be stored during testing operations. In certain embodiments, a separate gas storage tank may be added between the gas analyzer 214 and the gas and drilling fluid separator 221 to store the expelled gas 260 during testing operations. The gas analyzer 214 may analyze the gas 260 to determine properties of the gas 260 that would be appreciated by one of ordinary skill in the art in view of this disclosure. The properties include, but not limited to, chemical composition, mass, viscosity, etc.

In certain embodiments, the gas analyzer 260 may be communicably coupled to a surface control unit 213. The surface control unit 213 may have a similar configuration to surface control unit 113, having a processor and a memory device coupled to the processor. The surface control unit 213 may receive certain gas properties of the gas 260 and calculate formation properties based, at least in part, on the gas properties. The calculations may be performed based on instructions stored within the memory device that cause the processor to execute certain algorithms.

In certain embodiments, the flow of drilling fluid 270 within the drill string 207 may be reversed to accelerate the collection of expelled gas 260 at the surface. As described above, drilling fluid 270 typically is pumped downhole through the drill string 207 and returns to the surface within annulus 215. In certain embodiments, the fluid flow may be reversed, where the drilling fluid 270 is pumped downhole within the annulus 215 and retrieved through the drill string 207. In those embodiments, the gas and drilling fluid separator 221 may be in fluid communication with a surface reservoir (not shown) and deposit drilling fluid within the surface reservoir after the gas 219 has been removed.

In certain embodiments, a float valve 218 can be used in the drill string 207 to prevent the entry of gas from the bore hole 206 to the drill string 207. The valve 218 could be placed within or above the BHA 208 and is mechanically opened by the inner barrel assembly 216 when inner barrel assembly 216 is in place for coring. The valve is closed once the core is pulled via wireline to be retrieved to surface.

An example method for receiving expelled gas from a core sample of a formation includes positioning a tubular element within a borehole in the formation and capturing the core sample within a core chamber disposed within the tubular element. The method may also include receiving expelled gas from the core sample at a gas and drilling fluid separator in fluid communication with the core chamber. In certain embodiments, the tubular element may comprises an inner barrel assembly of a core sample assembly and the inner barrel assembly may be at least partially disposed within the outer barrel of the core sample assembly. The method may further include determining a property of the expelled gas and discarding the expelled gas.

In any of the embodiments described in this or the preceding paragraph, the gas and drilling fluid separator may be at least partially disposed within a gas storage chamber disposed within the inner barrel assembly; and coupled to a pump that provides fluid communication between the core chamber and the gas and drilling fluid separator. In any of the embodiments described in this or the preceding paragraph, receiving expelled gas from the core sample at the gas and drilling fluid separator may comprise pumping a suspension of the expelled gas and a drilling fluid from the core chamber into the gas and drilling fluid separator. Additionally, in any of the embodiments described in this or the preceding paragraph, the method may further include releasing pressure within the gas storage chamber using a valve that provides selective fluid communication between the gas storage chamber and an annulus between the inner barrel assembly and the outer barrel.

In any of the embodiments described in this or the preceding two paragraphs, the inner barrel assembly may be detachably coupled to the outer barrel. In any of the embodiments described in this or the preceding two paragraphs, the inner barrel assembly may at least partially disposed within an internal bore of a drilling assembly in the formation; and the gas and drilling fluid separator may be in fluid communication with the internal bore. Also, in any of the embodiments described in this or the preceding two paragraphs, the gas and drilling fluid separator may be positioned at a surface of the formation; and the gas and drilling fluid separator may be in fluid communication with a gas analyzer. Additionally, in any of the embodiments described in this or the preceding two paragraphs, the method may further include independently retrieving at the surface the inner barrel assembly using a wireline assembly.

An apparatus for receiving gas expelled from a core sample of a formation comprising a tubular element, a core chamber disposed within the tubular element, and a gas and drilling fluid separator in fluid communication with the core chamber. In certain embodiments, the tubular element may comprise an inner barrel assembly of a core sample assembly, and the inner barrel assembly may be at least partially disposed within the outer barrel of the core sample assembly. In any of the embodiments described in this paragraph, the apparatus may further comprise a gas storage chamber disposed within the inner barrel assembly, wherein the gas and drilling fluid separator is at least partially disposed within the gas storage chamber. In any of the embodiments described in this paragraph, the apparatus may further comprise a pump coupled to the gas and drilling fluid separator that provides fluid communication between the core chamber and the gas and drilling fluid separator. Additionally, in any of the embodiments described in this paragraph, the apparatus may comprise a valve that provides selective fluid communication between the gas storage chamber and an annulus between the inner barrel assembly and the outer barrel.

In any of the embodiments described in this or the preceding paragraph, the inner barrel assembly may be detachably coupled to the outer barrel. In any of the embodiments described in this or the preceding paragraph, the inner barrel assembly may be at least partially disposed within an internal bore of a drilling assembly in the formation, and the gas and drilling fluid separator is in fluid communication with the internal bore. In any of the embodiments described in this or the preceding paragraph, the gas and drilling fluid separator may positioned at a surface of the formation, and the gas and drilling fluid separator may be in fluid communication with a gas analyzer. Additionally, in any of the embodiments described in this or the preceding paragraph, the inner barrel assembly may be independently retrievable at the surface via a wireline latch mechanism. Also, the tubular element may be at least partially disposed within a drill string, and the drill string includes a valve that prevents formation fluid from entering the drill string.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A method for receiving expelled gas from a core sample of a formation, comprising: positioning an inner barrel assembly of a core sample assembly within a borehole, the inner barrel assembly at least partially disposed within an outer barrel of the core sample assembly; capturing the core sample within a core chamber disposed within the inner barrel assembly; and receiving expelled gas from the core sample at a gas and drilling fluid separator in fluid communication with the core chamber disposed within the inner barrel assembly and coupled to a pump configured to provide fluid communication between the core chamber and the gas and drilling fluid separator.

2. The method of claim 1, wherein receiving expelled gas from the core sample at the gas and drilling fluid separator comprising pumping a suspension of the expelled gas and a drilling fluid from the core chamber into the gas and drilling fluid separator.

3. The method of claim 2, further comprising releasing pressure within the gas storage chamber using a valve configured to provide selective fluid communication between the gas storage chamber and an annulus between the inner barrel assembly and the outer barrel.

4. The method of claim 1, further comprising detaching the inner barrel assembly from the outer barrel.

5. The method of claim 4, further comprising at least partially disposing the inner barrel assembly within an internal bore of a drilling assembly in the formation; and providing fluid communication between the gas and drilling fluid separator and the internal bore.

6. The method of claim 5, further comprising positioning the gas and drilling fluid separator at a surface of the formation; and providing fluid communication between the gas and drilling fluid separator and a gas analyzer.

7. The method of claim 4, further comprising independently retrieving at a surface the inner barrel assembly using a wireline assembly.

8. The method of claim 1, further comprising determining a property of the expelled gas and discarding the expelled gas.

9. An apparatus for receiving gas expelled from a core sample of a formation, comprising: a tubular element comprising an inner barrel assembly of a core sample assembly, the inner barrel assembly at least partially disposed within an outer barrel of the core sample assembly; a core chamber disposed within the tubular element; a gas storage chamber disposed within the inner barrel assembly; a gas and drilling fluid separator in fluid communication with the core chamber and at least partially disposed within the gas storage chamber; and a pump coupled to the gas and drilling fluid separator configured to provide fluid communication between the core chamber and the gas and drilling fluid separator.

10. The apparatus of claim 9, further comprising a valve configured to provide selective fluid communication between the gas storage chamber and an annulus between the inner barrel assembly and the outer barrel.

11. The apparatus of claim 9, wherein the inner barrel assembly is detachably coupled to the outer barrel.

12. The apparatus of claim 11, wherein the inner barrel assembly is at least partially disposed within an internal bore of a drilling assembly in the formation; and the gas and drilling fluid separator is in fluid communication with the internal bore.

13. The apparatus of claim 12, wherein the gas and drilling fluid separator is positioned at a surface of the formation; and the gas and drilling fluid separator is in fluid communication with a gas analyzer.

14. The apparatus of claim 11, wherein the inner barrel assembly is independently retrievable at a surface via a wireline latch mechanism.

15. The apparatus of claim 14, wherein the tubular element is at least partially disposed within a drill string; and the drill string includes a valve configured to prevent formation fluid from entering the drill string.

* * * * *